United States Patent [19]

Sasseen

[11] 4,408,620

[45] Oct. 11, 1983

[54] NOVELTY ITEM OF A CIGARETTE EXTINGUISHING ASHTRAY

[76] Inventor: Marvin W. Sasseen, 7145 Lindewood Pl., St. Louis, Mo. 63109

[21] Appl. No.: 311,412

[22] Filed: Oct. 14, 1981

[51] Int. Cl.[3] ..... A24F 13/18

[52] U.S. Cl. ..... 131/236; 131/237

[58] Field of Search ..... 131/236, 237; D27/8, D27/15–18, 22–24

[56] References Cited

U.S. PATENT DOCUMENTS 2,681,656 6/1954 Starkenberg ..... 131/236

*Primary Examiner*—V. Millin

*Attorney, Agent, or Firm*—Haverstock, Garrett & Roberts

[57] ABSTRACT

A novelty item of a cigarette extinguishing ashtray including an ash receiving receptacle having cigarette holders around its periphery, a track around the major portion of the periphery of the receptacle and adjacent the cigarette holders, an animated fireman figure movable along the track and including a hose for squirting water on cigarettes in the holders, and a mechanism for moving the figure along the track and squirting water from the hose when the figure is adjacent the cigarette holders.

17 Claims, 5 Drawing Figures

NOVELTY ITEM OF A CIGARETTE EXTINGUISHING ASHTRAY

The present invention is related to a novelty ashtray which, when activated, has an animated figure preferably in the form of a fireman which comes out of a hidden storage compartment and travels around the outer periphery of the ashtray, extinguishing cigarettes in the ashtray with water from a fireman's hose, and thereafter returns to the hidden storage compartment.

Ashtrays are known having various arrangements for extinguishing cigarettes placed in the ashtray using water from figurines mounted on the ashtray such as those disclosed in U.S. Pat. Nos. 1,855,983; 1,973,567 and 2,681,656, but none of these ashtrays include an animated figure which, when activated, moves around the ashtray and extinguishes cigarettes and the like as it moves. The present invention includes an ashtray having an animated fireman figure stored in a hidden storage compartment which, when activated, exits the storage compartment and travels around the periphery of the ashtray extinguishing cigarettes with a squirt of water from a hose held by the animated figure until the ashtray has been encircled, after which the fireman figure returns to the hidden storage compartment. Sensors may be included to sense the location of cigarettes in the ashtray and are connected to the operating mechanism of the fireman figure so that the fireman stops and squirts water only at those locations where cigarettes are located.

It is therefore a principle object of the present invention to teach the construction and operation of an improved novelty item of a cigarette extinguishing ashtray wherein an animated figure is stored in a hidden storage compartment in the base of the ashtray and exits only when activated.

Another object is to teach the construction and operation of a novelty cigarette extinguishing ashtray wherein an animated figure travels around the periphery of the ashtray extinguishing cigarettes therein with a squirt of water from a fireman's hose held by the animated figure.

Another object is to teach the construction of a novelty extinguishing ashtray having sensors around its periphery for sensing the presence of cigarettes in the ashtray.

These and other objects and advantages of the present device will become apparent after considering the following detailed specification in conjunction with the accompanying drawings wherein.

Figure 1:
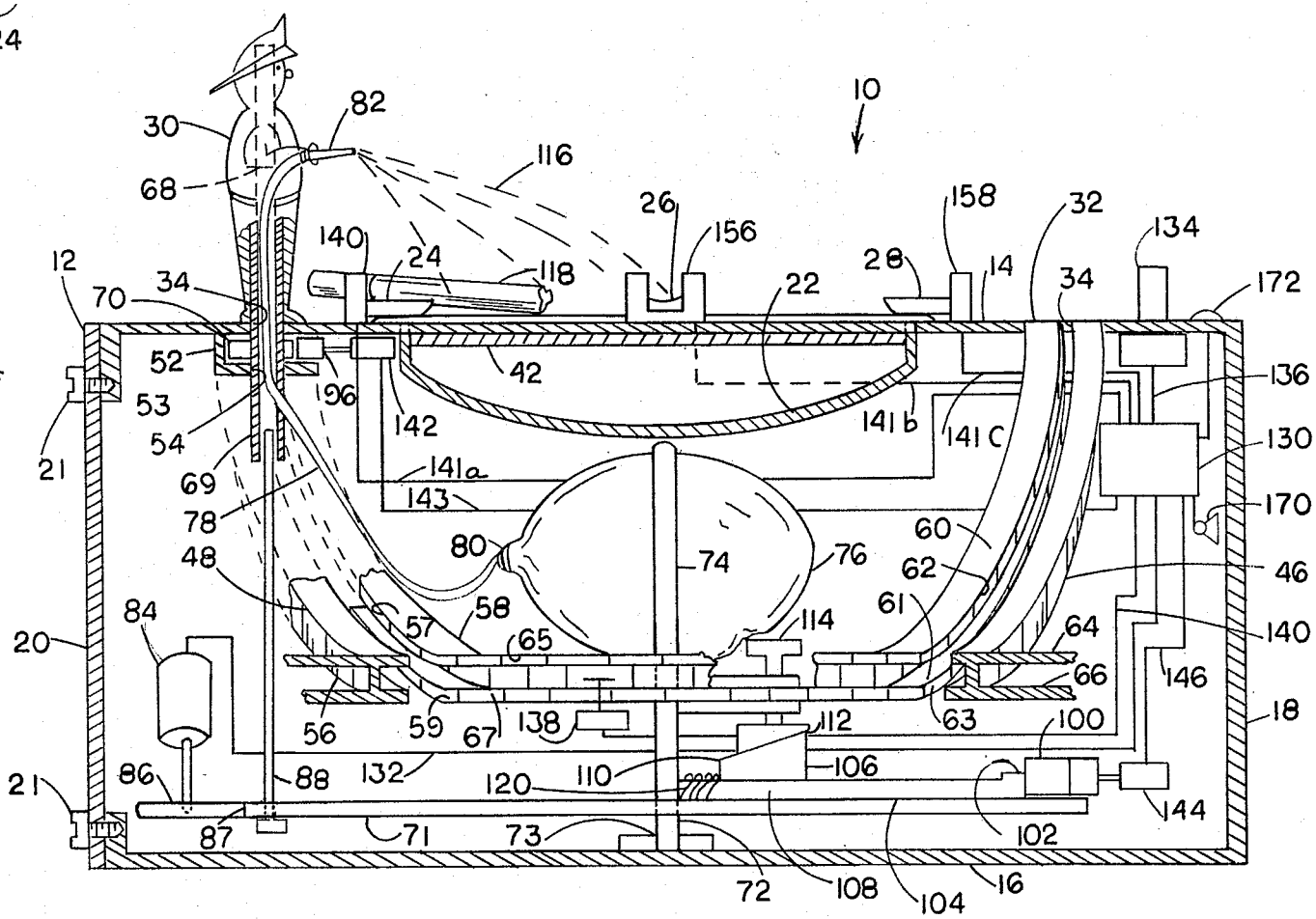
FIG. 1 is a cross-sectional view of a cigarette extinguishing ashtray constructed according to one embodiment of the present invention wherein a fireman figure is shown extinguishing a cigarette in the ashtray.

Referring to the drawing more particularly by reference numbers, number 10 in FIG. 1 identifies a novelty ashtray constructed according to one embodiment of the present invention. The novelty ashtray 10 includes a housing 12 having a top 14, a bottom 16 and sides 18 including a removable left side 20. The left side 20 is removable by fastening means such as screws 21 to allow access to the water reservoir and operating mechanism inside the housing 12 to be more fully described hereinafter.

A cigarette ash receiving receptacle 22 is located centrally in the top 14 of the housing 12 and includes cigarette troughs 24, 26 and 28 around its periphery.

An animated fireman figure 30 is actuatable to move around a circular track 32 (FIGS. 3 and 4) in the top 14. The circular track 32 includes a slot 34 through the top 14 which encircles three sides of the receptacle 22 so that the animated fireman figure 30 may move around most of the periphery of the receptacle, and which divides the top 14 into an outer peripheral portion 36 surrounding the outside of the track 32 and an inner portion 38 located on the inside of the circular track 32 surrounding the ashtray recptacle 22. The outer portion 36 and the inner portion 38 of the top 14 are formed of a single piece of material joined at 40 such that the inner portion 38 is cantilevered from the outer portion 36. Optionally, a support 42 is cantilevered from one of the side walls 44 of the housing 12 to supply added support to the inner portion 38. This allows the actuating mechanism for the fireman figure 30 which is located in the housing 12 to move in a complete circle without striking a center support, as will be described.

Figure 2:
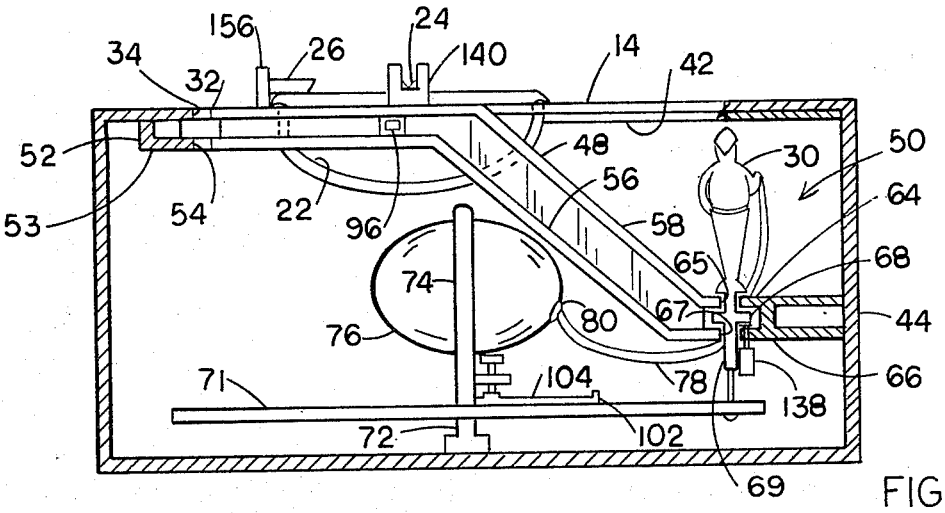
FIG. 2 is a left side elevational view of the ashtray with the side cut away showing the firearm figure in a hidden storage compartment.

The circular track 32 includes an up-ramp 46 and a down-ramp 48, and the track 32 passes through a hidden compartment 50 inside the housing 12 between the two ramps 46 and 48. As shown in FIG. 2, the fireman figure 30 is positioned in the hidden compartment 50 until the actuating mechanism is activated, whereupon the figure 30 moves up the up-ramp 46, around most of the periphery of the receptacle 22 and then down the down-ramp 48, returning to the hidden compartment 50 in the housing 12. The track 32 communicates with a lower track portion formed by a downwardly extending wall 52 and a connecting lower ledge 53 which extends to a lower slot 54 that is aligned below the track forming slot 34. As shown in FIG. 2, the down-ramp 48 is formed by a lower track member 56 which is below and parallel to an upper track member 58. The upper track member 58 has a slot 57 which communicates with and forms a continuation of the slot 34, and the lower track member 56 has a slot 59 which communicates with and forms a continuation of the slot 54 (FIG. 1). The up-ramp 46 has similar upper and lower track members 60 and 61, having slots 62 and 63, respectively, similarly communicating with and forming continuations of the slots 34 and 54 respectively. The circular track 32 is likewise formed by an upper track member 64 through the compartment 50 having a slot 65 that forms a continuation of and connects the upper ramp slots 57 and 62. A lower track member 66 also extends through the compartment 50 and has a slot 67 between the slots 59 and 63.

As shown in FIG. 1, the fireman figure 30 has a central cylindrical hole 68, and a tubular member 69 in at least a portion of the hole 68 which extends through the slots 34 and 54 and into the housing 12 when the FIG. 30 is moving around that portion of the track 32 in the top 14. An enlarged turning member 70 is located on the tubular extension 69, and is shown in FIG. 1 between the top 14 and the ledge member 53 of the lower track portion.

The actuating means of the fireman figure 30 includes a round turntable 71 supported by a center post 72 which has a pivotal attachment at 73 for allowing its rotation. The center post 72 extends through the turntable 71 and ends in a holding means 74 for holding a water reservoir which may be in the form of a squeeze bulb 76 as shown in FIGS. 1 and 2. A length of flexible hose 78 extends from a connection 80 in one end of the reservoir 76, through the slots 54 and 34 of the circular track 32 to a nozzle 82 held by the fireman figure 30. The turntable 71 is turned by a motor 84 having a drive wheel 86 arranged for engagement with the turntable edge 87. A post 88 is positioned in the turntable 71 and extends upwardly for slidable movement within the tubular extension 69. When the fireman figure 30 is in the hidden compartment 50 in the housing 12, the post 88 passes through the tubular extension 69 into the hole 68 in the center of the fireman figure 30. When the figure 30 moves up the up-ramp 46, the tubular member 69 slides up the post 88 until the figure 30 reaches the top of the ramp 46 and begins moving around the periphery of the receptacle 22. As shown in FIG. 1, the tubular extension 69 remains engaged with the post 88 when the fireman figure is in its uppermost position on the top 14 so that the post 88 will continue to move the fireman figure 30 around the circular track 32 as the turntable 71 turns around the center post 72.

Figure 4:
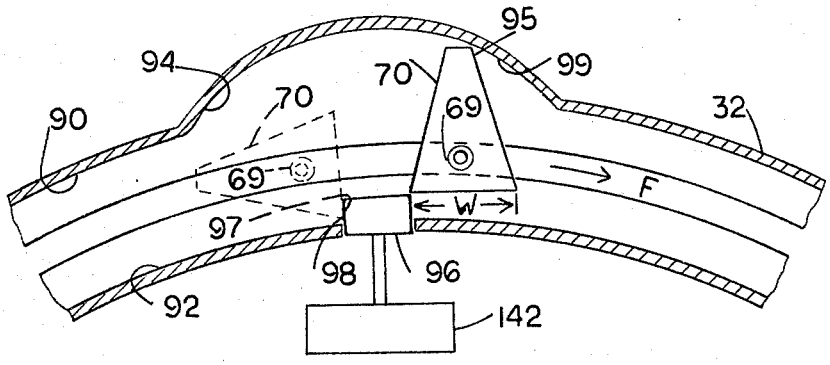
FIG. 4 is a bottom view of the turning mechanism for the animated figure.

As shown in FIG. 4 the enlarged turning member 70 located on the tubular extension 69 is triangular in shape and is sized to move between side walls 90 and 92 of the lower portion of the circular track 32. The width W of the turning member 70 is sized to be slightly smaller than the distance between the walls 90 and 92. When the figure 30 moves in the forward direction around the track 32 as indicated by the arrow F in FIG. 4, the figure 30 will be maintained in the forward facing direction by the turning member 70 which is trapped between the walls 90 and 92. The outer side wall 90 opposite the cigarette troughs 24–28 has turnouts 94 sized to receive the turning member 70 allowing the figure 30 to turn to face inwardly as shown in FIG. 1. A turning cam 96, actuatable by a solenoid 142, moves between the walls 90 and 92 into the pathway of the turning member 70 when the solenoid 142 is actuated such that the forward edge 97 of the turning member 70 engages the edge 98 of the turning cam 96 as shown by the dotted lines in FIG. 4, turning the member 70 into the turnout 94, thereby turning the fireman figure 30 to face inwardly toward the receptacle 22. When edge 95 of the turning member 70 engages the wall of the turnout 94 at 99 as shown by the solid lines in FIG. 4, the fireman figure 30 is turned to face in the forward direction and is held in the forward facing direction by the turning member 70 once again being trapped between the walls 90 and 92 as the figure 30 continues around the track 32.

Figure 3:
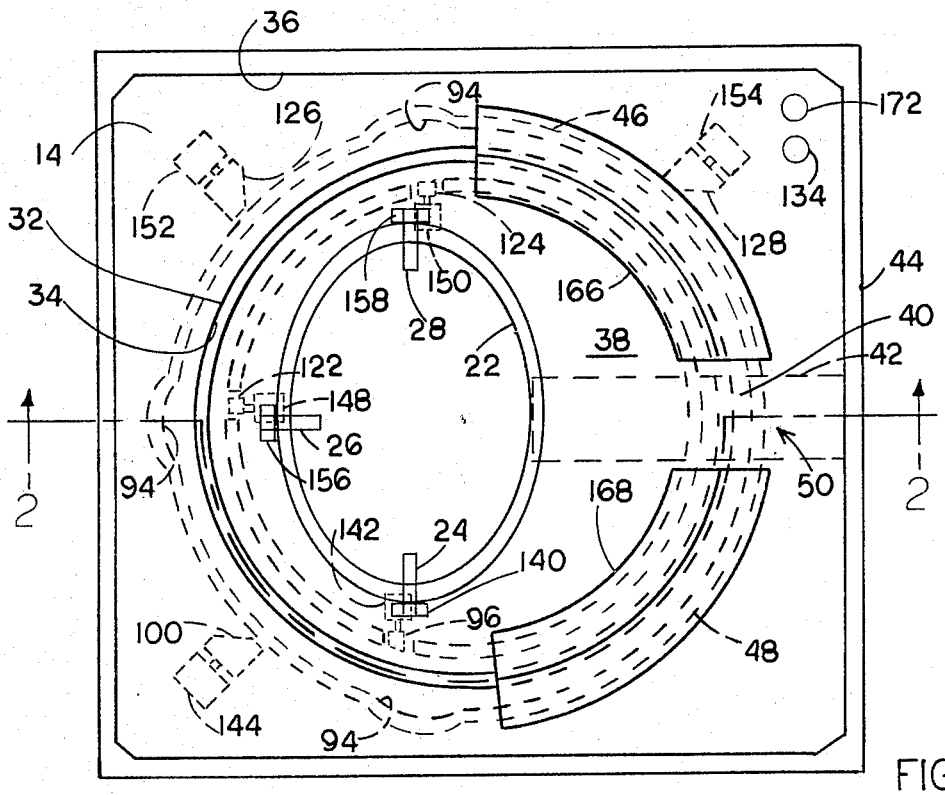
FIG. 3 is a top plan view of the device of FIG. 2.

After the figure 30 is turned inwardly as shown in FIG. 1, cam 100 engages one end 102 of push rod 104 having an enlargement 106 on its other end 108 (FIG. 1). When the push rod 104 is moved inwardly by the cam 100, an inclined surface 110 on the extension 106 co-acts with an inclined surface 112 on the end of a member 114, moving the member 114 upwardly to compress the water reservoir 76. The compression of the water reservoir 76 forces water through the hose 78 and out the nozzle 82 as shown at 116. A coil spring 120 located on the end 108 of the push rod 104 returns the rod 104 to its original position after the end 102 passes the cam 100 as the turntable 71 continues to turn. The position of the cam 100, the push rod 104 and the member 114 of the squirting mechanism as shown in FIG. 1 are rotated with respect to their preferred locations for clarity. The preferred locations are shown in FIG. 3 and are arranged such that the fireman figure 30 first turns towards a cigarette 118, and then squirts water out of the nozzle 82, as explained, for extinguishing the cigarette. The other cigarette troughs 26 and 28 have similar turning cams 122 and 124, respectively, and squirt cams 126 and 128, respectively, as shown in FIG. 3.

The motor 84 is connected to a control circuit 130 by lead 132. An ON button 134 in the top 14 of the housing 12 is connected to the control circuit 130 by the lead 136. An OFF switch 138 is located in the lower member 66 of the track 32 in the hidden compartment 50 and is connected to the control circuit 130 by lead 140. The mechanism is activated by pushing the ON button 134 whereupon the motor 84 is energized to turn the drive wheel 86, rotating the turntable 71 and moving the fireman figure 30 out of the hidden compartment 50 and up the up-ramp 46 as previously described. When the figure 30 makes a complete trip around the track 32 and returns to the hidden compartment 50, the turning member 70 strikes the OFF switch 138 as shown in FIG. 2, thereby turning off the motor 84.

The troughs 24, 26 and 28 include sensors 140, 156 and 158 respectively as shown in FIG. 1 for sensing the presence of a cigarette. The sensors 140 156 and 158 are connected to the control circuit 130 by lead 141*a*, 141*b* and 141*c* respectively. When cigarette 118 is located in the trough 24, the control circuit 130 activates the turning solenoid 142 over lead 143, moving the turning cam 96 between the walls 90 and 92. Also responsive to sensing the cigarette 118 by the sensor 140, the control circuit 130 activates solenoid 144 over lead 146 for extending the squirt cam 100 such that it will engage the end 102 of the push rod 104 as the turntable 71 rotates, thereby squirting water out of the nozzle 82 as previously described. Turning cams 122 and 124 have solenoids 148 and 150 respectively, and squirt cams 126 and 128 have solenoids 152 and 154, respectively. The solenoids 148–152 are also connected to the control circuit 130 for activation by sensors the 156 and 158 in a manner similar to that described in connection with sensor 140 and solenoids 142 and 144.

Figure 5:
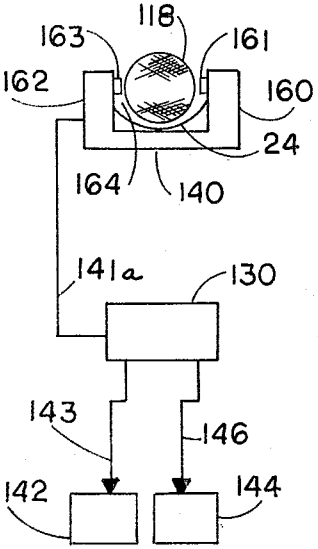
FIG. 5 is a schematic view of one embodiment of a cigarette sensor for use with the device.

FIG. 5 shows one embodiment of the sensors wherein the illustrated sensor 140 is generally U-shaped with one side 160 having a light source 161 for shining a light beam through open space 164 to the other side 162 having a photodiode 163. When the cigarette 118 is placed in the trough 24, it extends through the space 164, breaking the lightbeam between the source 161 and the diode 163. A signal is then sent over lead 141*a* to the control circuit 130 which activates the turning solenoid 142 and squirting solnoid 144 over leads 143 and 146 respectively, activating the turning cam 96 and the squirt cam 100 for turning the figure 30 and squirting water on the cigarette 118 respectively when the figure 30 reaches the trough 24 as described. The sensors 156 and 158 are similarly connected to the control circuit 130 by leads 141*b* and 141*c* respectively for sensing and extinguishing cigarettes in the troughs 26 and 28.

Pushing the start bottom 134 activates the motor 84 turning the turntable 71 and moving the fireman figure 30 out of the hidden chamber 50 and around the circular track 32. The sensors 140, 156 and 158 sense the presence of cigarettes in the troughs 24, 26 and 28, respectively, activating the turning cams and squirt cams corresponding to the troughs 24–28 in which cigarettes are sensed. As the fireman figure 30 reaches a turning cam which has been activated, the fireman figure 30 turns facing the cigarette trough containing the cigarette, and squirts water out of nozzle 82 responsive to the end 102 of the push rod 104 engaging the corresponding one of the squirt cams which has been activated by the control circuit 130, thereby extinguishing the sensed cigarette. The fireman figure then turns back facing the forward direction, and continues around the circular track 32 to the next activated turning cam. After the figure 30 has made a complete trip around the track 32, it returns to the hidden compartment 50 turning off the motor 84 by engaging the OFF switch 138.

The up-ramp 46 may include a pair of spring loaded trap doors 166 and the down ramp 48 may include a pair of spring loaded trap doors 168 for covering the ramps until pushed open by the fireman figure 30 moving along the track 32. When the doors 166 and 168 are used, the top 14 will be completely closed, hiding the fireman figure 30 from view until the ON button 133 has been activated. A siren 170 and a flashing light 172 may optionally be controlled by the control circuit 130 for activation as the figure 30 is moved around the track 32.

The motor 84 may also be activated by a cigarette being sensed by one of the sensors 140, 156 and 158 so that the fireman figure 30 will automatically move around the receptacle 22 to extinguish a cigarette responsive to a cigarette being placed in one of the troughs 24, 26 or 28.

Thus, there has been shown and described an embodiment of a novelty item of a cigarette extinguishing ashtray which fulfills all of the objects and advantages sought therefor. It will be apparent to those skilled in the art, however, that many changes, modifications, variations, and other uses and applications of the subject device are possible. All such changes, modifications, variations and other uses and applications which do not depart from the spirit and scope of the invention are covered by the claims which follow.

What is claimed:

1. An ashtray comprising a receptacle having at least one cigarette holder at a location on the periphery thereof, a track having a portion thereof extending around at least a portion of said receptacle, said track having spaced control surfaces thereon, an animated figure including means supporting said figure for movement along said track, other means including a source of liquid and means connecting the source of liquid to said figure, means associated with said figure engageable with the control surfaces on said track to control the supply of liquid from said source to said figure for discharging thereby at a cigarette positioned in said cigarette holder, and means operatively connected to said figure for moving said figure along said track.

2. The ashtray of claim 1 wherein said animated figure is in the form of a fireman holding a firehose.

3. The ashtray of claim 1 including means associated with said track for turning said animated figure to face each of said cigarette holders when said figure is on that portion of said track adjacent said cigarette holders.

4. The ashtray of claim 1 wherein said ashtray includes a compartment for concealing said animated figure in a preselected position thereof.

5. The ashtray of claim 4 wherein said track includes ramp portions extending between said concealing compartment and that portion of said track around said receptacle.

6. The ashtray of claim 3 including sensors associated with said cigarette holder for sensing the presence of a cigarette in said holder, said discharge operating means and said turning means being responsive to said sensors such that said animated figure turns and discharges extinguishing liquid on cigarettes sensed by said sensors.

7. The ashtray of claim 1 including means connected to said moving means for generating audio and visual signals during at least a portion of the movement of said animated figure.

8. An ashtray comprising a receptacle having a plurality of cigarette holders spaced around the periphery thereof, a track having a portion thereof extending around at least a portion of said receptacle, said track having spaced control surfaces thereon, a figure including means supporting said figure for movement along said track, other means including a source of liquid and means connecting the source of liquid to said figure, means associated with said figure engageable with the control surfaces on said track to control the supply of liquid from said source to said figure for discharging thereby at a cigarette in the ashtray, and means operatively connected to said figure for moving said figure along said track, said ashtray including a compartment for concealing said figure in a preselected position thereof.

9. The ashtray defined in claim 8 wherein said figure is in the form of a fireman holding a firehose.

10. The ashtray defined in claim 8 including means associated with said track for turning said figure to face any one of said cigarette holders when said figure is on that portion on said track adjacent said cigarette holders.

11. The ashtray defined in claim 8 wherein said track includes ramp portions extending between said concealing compartment and that portion of said track around said receptacle.

12. The ashtray defined in claim 10 including sensors associated with said plurality of cigarette holders for sensing the presence of a cigarette in said holders, said discharge operating means and said turning means being responsive to said sensors such that said figure turns and discharges extinguishing liquid on cigarettes sensed by said sensors.

13. The ashtray defined in claim 8 including means connected to said moving means for generating audio and visual signals during at least a portion of the movement of said figure.

14. An ashtray comprising a receptacle having a plurality of cigarette holders spaced around the periphery thereof, a track having a portion thereof extending around at least a portion of said receptacle, said track having spaced control surfaces thereon, a figure including means supporting said figure for movement along said track, other means including a source of liquid and means connecting the source of liquid to said figure, means associated with said figure engageable with the control surfaces on said track to control the supply of liquid from said source to said figure for discharging thereby at a cigarette in the ashtray, means operatively connected to said figure for moving said figure along said track, means associated with said track for turning said figure to face said cigarette holders when said figure is on that portion of said track adjacent said cigarette holders, and sensors associated with said plurality of cigarette holders for sensing the presence of a cigarette in any one of said holders wherein said discharge operating means and said turning means are responsive to said sensors such that said figure turns and discharges extinguishing liquid on cigarettes sensed by said sensors.

15. The ashtray defined in claim 14 wherein said figure is in the form of a fireman holding a firehose.

16. The ashtray defined in claim 14 including a compartment for concealing said figure in a preselected position thereof.

17. An ashtray comprising a receptacle having a plurality of cigarette holders spaced around the periphery thereof, a track having a portion thereof extending around at least a portion of said receptacle, said track having spaced control surfaces thereon, a figure including means supporting said figure for movement along said track, other means including a source of liquid and means connecting the source of liquid to said figure, means associated with said figure engageable with the control surfaces on said track to control the supply of liquid from said source to said figure for discharging thereby at a cigarette in the ashtray, means operatively connected to said figure for moving said figure along said track, and means connected to said moving means for generating audio and visual signals during at least a portion of the movement of said figure.

* * * * *

UNITED STATES PATENT AND TRADEMARK OFFICE

CERTIFICATE OF CORRECTION

PATENT NO. : 4,408,620

DATED : October 11, 1983

INVENTOR(S) : Marvin W. Sasseen

It is certified that error appears in the above-identified patent and that said Letters Patent is hereby corrected as shown below:

Column 2, line 18, "recptacle" should read -- receptacle --.

Column 4, line 60, "bottom" should be -- button --.

Signed and Sealed this

*Twenty-third* Day of *October 1984*

[SEAL]

*Attest:*

GERALD J. MOSSINGHOFF

*Attesting Officer*

*Commissioner of Patents and Trademarks*